United States Patent [19]

Banahan

[11] 3,946,722

[45] Mar. 30, 1976

[54] AMBULATORY TAR APPLICATOR

[76] Inventor: Robert J. Banahan, 3949 N. Olcott Ave., Chicago, Ill. 60634

[22] Filed: Dec. 7, 1973

[21] Appl. No.: 422,741

[52] U.S. Cl. ..... 126/343.5 A

[51] Int. Cl.[2]... E01C 19/45; F24H 1/06; F24H 1/46

[58] Field of Search..... 126/343.5 R, 343.5 A, 19.5

[56] References Cited

UNITED STATES PATENTS

| | | | |
|---|---|---|---|
| 2,123,604 | 7/1938 | Johnson | 126/343.5 R |
| 2,317,480 | 4/1943 | Peters | 126/343.5 A |
| 2,839,332 | 6/1958 | Sackett | 126/343.5 A |
| 3,189,022 | 6/1965 | Melsky | 126/343.5 A |
| 3,499,678 | 3/1970 | Richler | 126/343.5 A |
| 3,537,443 | 11/1970 | Becker | 126/343.5 A |

*Primary Examiner*—William F. O'Dea
*Assistant Examiner*—Ronald C. Capossela
*Attorney, Agent, or Firm*—John J. Kowalik

[57] ABSTRACT

A mobile applicator for roofing tar having advance spray nozzles followed by spreader brushes carried on a wheeled motorized chassis which also supports a tar hopper which is maintained in heated condition and agitated by the exhaust of an internal combustion engine which drives the apparatus, the engine exhaust being selectively ported to heat the hopper or to by pass the same when the liquid tar becomes sufficiently hot to prevent overheating and also to maintain the lines from the hopper to the spray hot to prevent solidification of the sealant, viz., the tar.

6 Claims, 3 Drawing Figures

FIG. 2
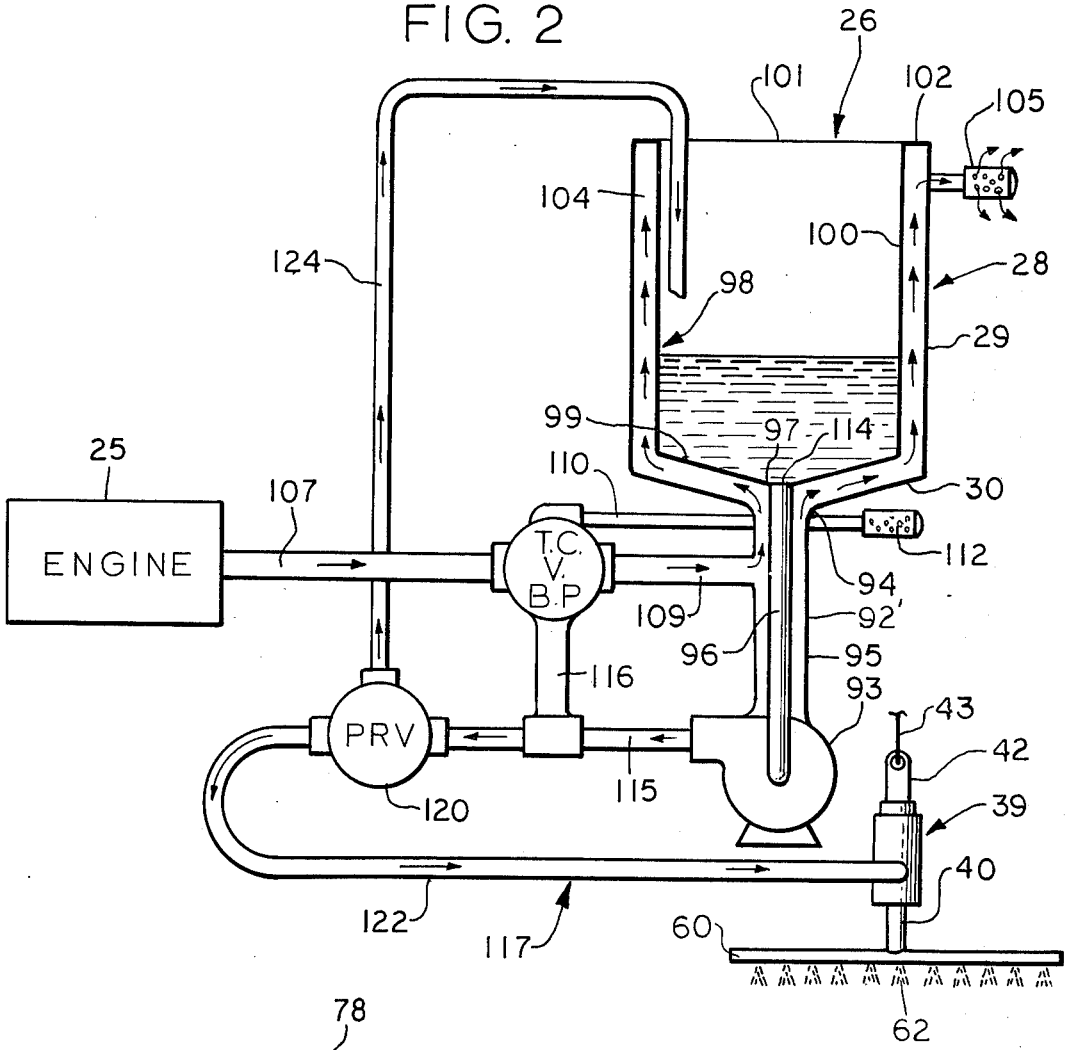
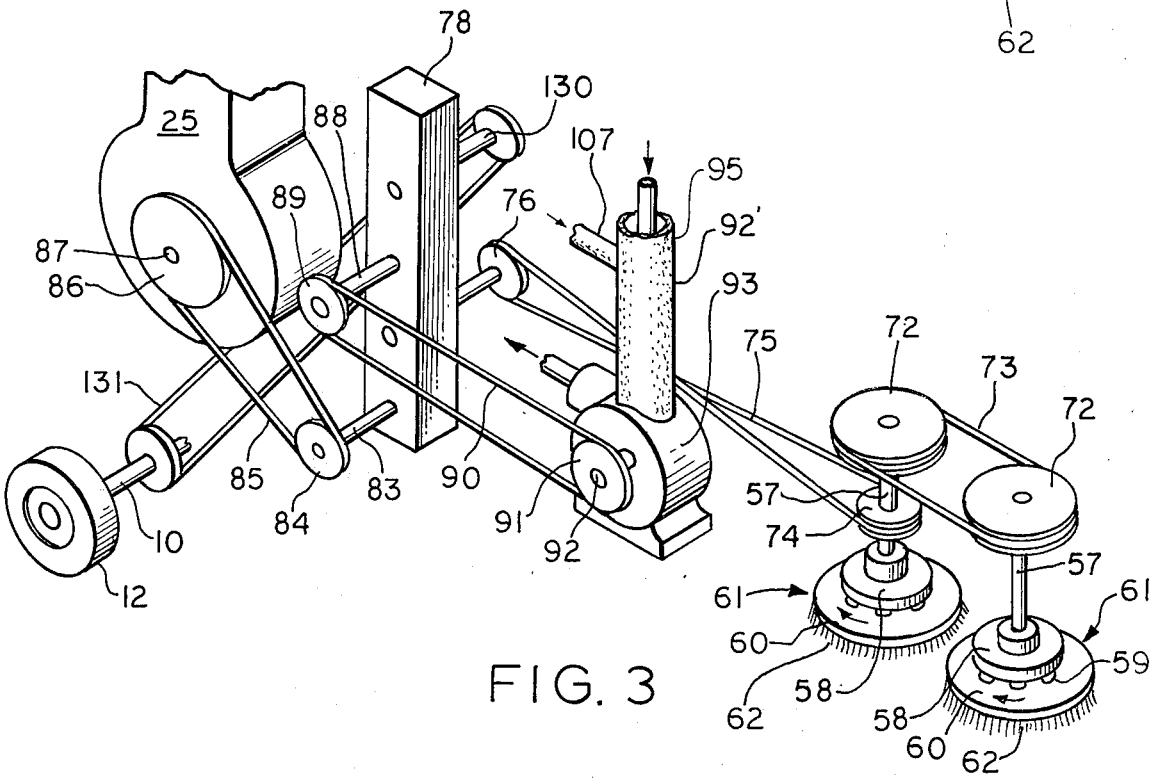
FIG. 3

AMBULATORY TAR APPLICATOR

BACKGROUND OF THE INVENTION

It has come to my attention that no practical, easily manueverable self-contained apparatus is presently available for hoisting onto a building roof for facile application of roofing tars. The usual system requires a ground crew with a heating tank into which buckets are dipped and hoisted to the roof by a pulley line. The transit of the heated tar is inneficient, dangerous and odoriferous. The time consuming opeation is not only physically exhausting but also consumes enormous amounts of energy since the tar must be superheated so as not to solidify before application. Mops are used for spreading which are conductive to uneven application.

SUMMARY OF THE INVENTION

This invention is directed to a novel self-contained apparatus which is readily portable and maneuverable on a roof for directly applying a heated sealing compound thereto.

A general object of the invention resides in a novel assembly of components which contribute to provide a simple and effective applicator of the roofing compound.

A more specific object is to devise a novel apparatus in which the exhaust heat of the driving engine is utilized through a heat exchanger encompassing the tar tank to heat the tar and maintain it in liquid state.

A further object is to provide a novel system for not only heating the tar hopper but which also maintains the distributor lines in heated condition to prevent coagulation of the roofing compound.

Another object is to devise a novel recirculating system for returning excess sealing liquid to the hopper when the applicator nozzles are closed or throttled so as to prevent freeze up in the lines.

A still further object is to provide a novel applicator which provides a leading spray apparatus for pressure spraying of the liquid tar followed by intermediately positioned universally mounted rotary-driven spreader brushes to scuff the underpaper and thoroughly impregnate the same and then followed by a rearwardly position squeegee or rubber wiper blades to even the coating.

A further object is to provide a novel applicator apparatus in which the controls are mounted for easy manipulation. A still further object is to devise a novel apparatus having a wheeled, light-weight, skeletal framework and wherein the tar tank is located in a strategic location for holding the brushing apparatus against the work area and wherein the internal combustion engine is mounted in balancing relation to the tank and the exhaust system which heats the tank discharges remotely from the operator who guides the machine by a handle structure extending upwardly and rearwardly therefrom.

The invention contemplates a novel organization of components which serve in multiple capacities and in which the components are disposed in a close-coupled arrangement for weight saving and in such manner that loads are localized where required.

These and other objects and advantages inherent in and encompassed by the invention will become more readily apparent from the specifications and the drawings, wherein:

FIG. 2 is a partly diagrammatic illustration of a portion of the structure shown in FIG. 1 on a different scale; and FIG. 3 is a perspective view of the driving train of the apparatus.

DESCRIPTION OF THE INVENTION

Figure 1:
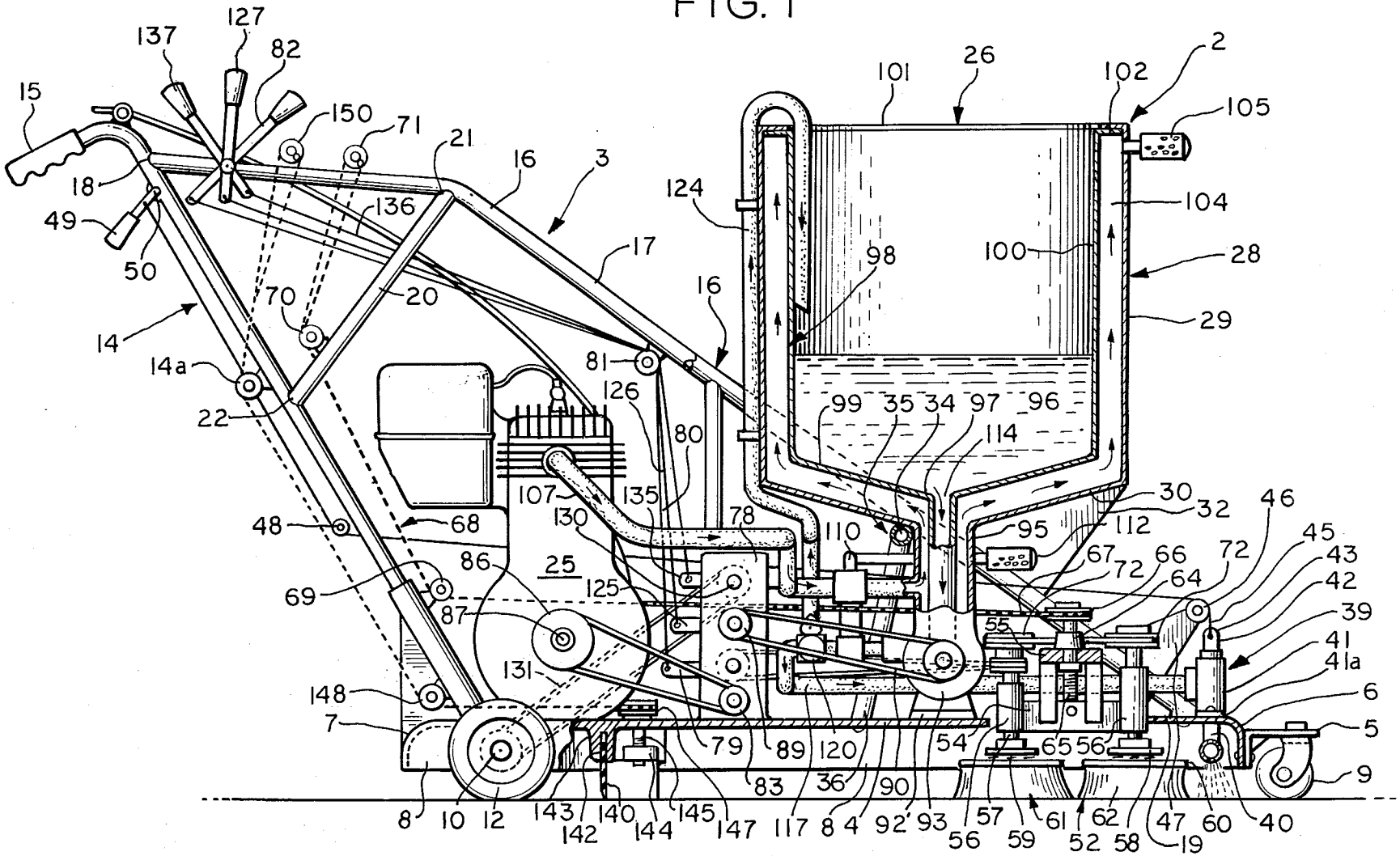
FIG. 1 is a side elevational view partly in section of the invention.

The applicator apparatus generally designated 2 comprises a skeletal framework 3 which includes a deck plate 4 with a depending peripheral wall having front and rear wall portions 6 and 7 and laterally spaced side wall portions 8,8 which define a downwardly open housing.

A bracket 5 is mounted on the front wall portion 6 adjacent each side wall of the housing and mounts a caster wheel 9 which steerably carries the front end of the unit.

The side wall portions journal a transverse axle 10 adjacent to the rear wall 7, said axle being connected to drive wheels 12 which are disposed at opposite sides and support the rear end of the unit.

A handle structure 14 is attached to the rear portion of the framework 3 and extends diagonally upwardly and rearwardly therefrom and terminates at its upper end in a pair of laterally diverging handle bars 15,15 which are adapted to be grasped by the workman to guide the unit.

The handle structure is reinforced by side bracing frames 16,16 each of which comprises an upper tension member 17 which at one end is connected to the upper end of one of the handles as at 18 and which slopes downwardly toward the forward end of the deck and is connected as at 19 thereto. A column 20 is connected at one end 21 to the tension member 17 intermediate its ends and the other end of the column is connected as at 22 to the respective handle bar intermediate its upper and lower ends.

A prime mover in the form of an internal combustion engine 25 is mounted upon and bolted to the deck adjacent to the rear end thereof and adjacent to the forward end of the unit there is mounted upon the deck a tar hopper or tank 26 in counterbalancing relation to the engine. The hopper comprises a casing or outer shell 28 which has a cylindrical upper body portion 29 and a funnel-like lower portion 30. The lower portion 30 is integrally connected on its forward side to gusset plates 32 which are suitably connected as by welding or bolting to the deck plate 4. The rear side of the portion 30 is connected to the bight portion 34 of an inverted U-shaped brace bar 35 which has laterally spread legs 36, each of which are connected at their lower ends as at 37 to the intermediate portion of the deck plate 4.

The forward portion of the deck is apertured and supports a tar spray assembly 39 which comprises a nozzle structure 40 projecting below the deck plate 4 behind the front wall portion 6. The spray assembly has a manifold block 41 mounted by bracket **41*a* to the top of the deck and the block is provided with a suitable valving 42 and porting to control the spray through the nozzles. The valving 42 is controlled by a valve stem 43 spring-biased to closed position, the stems projecting upwardly from the valve block or housing 41 and being connected to a control wire 45 which extends over a pulley 46 mounted from a bracket 47 on the deck plate 4. The wire 45 extends to the rear of the deck under a pulley 48 mounted on one of the handle bars and then extends upwardly to a pivoted handle control 49 supported with a friction or other incremental lock 50 on one of the handle bars, the control 49** being easily accessible to the operator.

Immediately rearwardly of the nozzles a rotary brush asembly 52 is supported from the deck plate, said assembly 52 comprising a support block 54 which adjustably mounts a frame 55. The frame 55 carries a plurality of laterally spaced and fore and aft offset bearing sleeves 56,56 each of which journals a vertical shaft 57, the lower end of which is connected to a mounting plate 58. Each plate 58 supports and drives a plurality of annularly arranged dependent helical springs 59,59. The springs 59 serve as yieldable universal mounts for an annular backing base 60 of a brush 61 which has its bristles 62 embedded therein.

The brush frame has a bearing 64 which journals an adjusting screw 65 which is threaded through the support block 54 which is secured (preferably weld-connected) to the deck plate 4. The upper end of the adjusting screw 65 is provided with a sprocket 66 about which there is trained a chain 67 of an adjustment control 68, the chain being trained under a guide pulley 69 on the handle structure and behind a pulley 70 on the side frame brace and about a crank pulley 71 which is journaled on the upper beam 17 of the side frame of the unit.

The brush shafts 57 are each provided with a pulley 72. A drive belt 73 (FIG. 3) is wrapped about the pulleys 72 and the brush shaft 57 is provided with an additional pulley 74 which is driven by a twisted belt 75. Belt 75 is wrapped about a pulley 76 which extends from a transmission box 78 mounted on the deck plate 4 ahead of the engine. The gearing and clutch for the brushes (not shown) is controlled by a lever 79 mounted on the gear case and connected to wire 80 which is trained over a pulley 81 supported on the frame element 17, the wire extending to the lower end of lever 82 which is pivotally supported on the frame element 17 adjacent the handles 15.

The gearing in the gear case is driven from an input shaft 83 which has a pulley 84 connected thereto. Pulley 84 is driven by a belt 85 which is trained about a pulley 86 on the output shaft 87 of the engine.

The gear train also has an output shaft 88 with a pulley 89 driving a belt 90 which is wrapped about a pulley 91 of a pump shaft 92 part of a pump 92'. The pump shaft 92 is rotatably mounted in a pump housing 95 which encloses an impeller (not shown) as is well known. The housing 93 is mounted on the deck plate 4 beneath the apex 94 of the tar hopper and has an upwardly extending hollow tubular portion 95 preferably integrally united with the apex of the outer shell portion of the hopper, it being understood that the portion 95 may be flanged and bolted to the shell portion 30. The tubular portion 95 of the pump housing surrounds an outlet pipe 96 which is centered in the portion 95 and at its upper end is integral with the apical portion 97 of the inner shell 98 of the hopper, the inner shell having a funnel-like conical lower end portion 99 which forms the bottom end of a cylindrical upper body portion 100. The upper end 101 of the body portion 100 is connected by a ring or annulus 102 to the upper end of the outer shell 28 forming therewith a hot gas chamber 104 which blankets the inner shell and is connected adjacent to the ring 102 to a muffler 105 which serves as an outlet for the hot exhaust gases generated by the internal combustion engine. These gases are ported from the engine exhaust port by a pipe 107 which leads to a temperature control by-pass valve 108 (FIG. 2) and in one position of the valve passes the gases through the valve to a line or pipe 109 which connects with the tubular extension 95 of the pump housing for delivering the hot exhaust gases thereto heating the exhaust tube 96 of the hopper to maintain the tar therein in a viscous or fluid state while also heating the pump housing and parts to prevent freeze up and also heating the hopper. The temperature control by-pass valve 108 is heat sensitive and is set to close its outlet to the pipe 107 upon the gas temperature reaching a predetermined maximum such as would excessively boil the tar as to cause it to smoke or deteriorate its quality. The valve then opens another port which communicates with an exhaust pipe 110 for conducting the hot exhaust gases through a muffler 112 to the atmosphere, the muffler 112 being located directly under the hopper to maintain a localized heated area under the tank at the outlet 114 of the hopper.

As best seen in FIG. 2 the temperature control by-pass valve has a standard 116 preferably supported from an outlet pipe 115 of the pump located below the valve. This feature transmits vibratory pulses of the exhaust gases to the pump outlet piping and the plumbing generally designated 117 connected thereto to facilitate movement of the fluid tar through the same. This vibratory feature is also transmitted to the heat exchanger chamber of the hopper to continuously agitate the liquid to inhibit congealing and through the metal deck panel to the spray valving and nozzles to prevent plugging.

As best seen in FIG. 2 the pump outlet pipe 115 is connected to a pressure regulator valve 120 which is set to direct the liquid tar through a pipe 122 to the spray manifold 41 through the valving 42 and thence to the nozzles 40. After a predetermined pressure rise in the pipe 122, the valve 120 diverts a part or all of the fluid tar (if the nozzles malfunction) to a by-pass line 124 which leads upwardly and is turned into the tank or hopper thus recirculating the material.

The drive from the gear box to the pump is controlled by a lever and clutch assembly 125 mounted on the gear case and controlled by a wire or handle 127, mounted on the unit side frame as best seen in FIG. 1, whereat movement of the handle 127 which may be locked in any selected position, moves the wire 126 and thus operates the mechanism 125.

The gear box also supports a wheel-drive shaft and pulley assembly 130 (FIG. 3) which is suitably geared to the engine driven input shaft 83. The assembly 130 drives a belt 131 which in turn drives a pulley 132 connected to the rear axle shaft 10. The wheel-drive assembly 130 is controlled by a clutch and lever mechanism 135 of well known construction and such mechanism is connected by a cable 136 to a movable detent-controlled handle 137 mounted on the unit side frame adjacent to the handle structure.

Forwardly of the rear wheels below the deck plate 4 there is positioned a doctor blade or wiper 140 (FIG. 1) which may be of rigid metal or flexible plastic material of flat sheet stock. It is mounted for vertical movement within a slot 142 of a bracket 143 depending from the underside of the deck plate. The blade 140 has a forwardly projecting arm 144 attached thereto into which is threaded an adjuster 145 rotatably mounted in a fixed bearing secured to the deck plate 4. The upper end portion of the adjuster is secured to a sprocket 147 which is driven by a chain suitably guided by guides 148,149 to a sprocketed crank 150 mounted on the unit side frame adjacent handle 15 for easy access to the operator. The wiper blade or squeegee functions to level the tar into a uniform sheet or film over the substrata of tar paper and the like.

From the foregoing description it will be realized that a preferred embodiment of the invention has been disclosed which is intended to illustrate an exemplary mode of practicing the invention and is not to be regarded in any limiting sense, or the scope of coverage which is to be considered only as set forth in the appended claims:

I claim:

1. In a mobile roof tarring device, storage means for containing a quantity of molten tar compound, and combined unitary means for:

a. heating the compound in said storage means to melt the same and for maintaining the compound in a fluid state and for b. agitating the compound for maintaining the same in said fluid state and for enhancing the flow of said compound from the hopper and through associated distributing means, and said means for heating and agitating the compound comprising an internal combustion engine and means for conducting exhaust gases therefrom, including a heat exchanger means in heat transfer relation to the storage means, and a temperature control by-pass valve in said exhaust conducting means for diverting the exhaust gases from the heat exchanger means to an area providing localized heating of the storage means.

2. The invention according to claim 1 and said unitary means comprising pulsating heated gases, and means for circulating such gases about the storage means.

3. The invention according to claim 1 and means for inhibiting heating of said compound while continuing agitation of the compound to maintain the same in fluid state.

4. The invention according to claim 1 and said device comprising an ambulatory unit and said storage means and unitary means supported thereon in counterbalancing relation.

5. The invention according to claim 4 and said unitary means comprising said internal combustion engine and ducting for porting the exhaust gases to the storage means for heating and vibrating the same.

6. The invention according to claim 1 and said area comprising outlet port means for the storage means.

* * * * *